US008225693B2

(12) United States Patent
Hanson et al.

(10) Patent No.: US 8,225,693 B2
(45) Date of Patent: Jul. 24, 2012

(54) CONTROL LEVER MECHANISM ADAPTED TO BE MOUNTED TO A COWL OF A MATERIALS HANDLING VEHICLE

(75) Inventors: Eric J. Hanson, Troy, OH (US); Jason R. Kremer, New Bremen, OH (US); Julien J. Schrenk, Leesburg, VA (US)

(73) Assignee: Crown Equipment Corporation, New Bremen, OH (US)

( * ) Notice: Subject to any disclaimer, the term of this patent is extended or adjusted under 35 U.S.C. 154(b) by 1081 days.

(21) Appl. No.: 11/689,085

(22) Filed: Mar. 21, 2007

(65) Prior Publication Data

US 2007/0221010 A1 Sep. 27, 2007

Related U.S. Application Data

(60) Provisional application No. 60/784,176, filed on Mar. 21, 2006.

(51) Int. Cl.
*G05G 1/04* (2006.01)

(52) U.S. Cl. ..... 74/523

(58) Field of Classification Search ..... 74/469, 74/473.3, 473.33, 490.12, 490.14, 490.15, 74/491, 519, 523; 414/629, 631, 635, 641, 414/644

See application file for complete search history.

(56) References Cited

U.S. PATENT DOCUMENTS

| | | | | |
|---|---|---|---|---|
| 3,737,003 | A | 6/1973 | Beals et al. | |
| 3,841,698 | A | 10/1974 | Stammen | |
| 3,916,717 | A | 11/1975 | Heintz | |
| 3,985,394 | A * | 10/1976 | Rolfes | 406/41 |
| 4,026,349 | A | 5/1977 | Schaap | |
| 4,291,896 | A | 9/1981 | Koch | |
| 4,392,669 | A | 7/1983 | Martin, Jr. | |
| RE31,646 | E | 8/1984 | Beals et al. | |
| 4,664,220 | A | 5/1987 | Ruhter et al. | |
| 4,664,221 | A | 5/1987 | Loney et al. | |
| 4,682,787 | A | 7/1987 | Ruhter et al. | |
| 4,706,776 | A | 11/1987 | Hyoki et al. | |
| 4,981,047 | A | 1/1991 | Denda et al. | |
| 5,056,983 | A | 10/1991 | Naruse et al. | |
| 5,056,985 | A | 10/1991 | Johnson et al. | |
| 5,138,756 | A * | 8/1992 | Johnson et al. | 29/401.1 |

(Continued)

FOREIGN PATENT DOCUMENTS

GB 717 876 A 11/1954

(Continued)

OTHER PUBLICATIONS

Amended claims sent to the European Patent Office for European Patent Application No. 07758999.2.

(Continued)

*Primary Examiner* — Vicky Johnson
(74) *Attorney, Agent, or Firm* — Stevens & Showalter LLP

(57) ABSTRACT

A control lever mechanism is provided for being mounted to a cowl of a main body of a materials handling vehicle. The control lever mechanism may comprise at least one lever structure including a control lever having a section which falls within or is approximately parallel with a lowermost view plane of a view zone of an operator, wherein the operator view zone includes at least one view plane positioned above the lowermost view plane, and apparatus for mounting the lever structure to the main body cowl.

28 Claims, 9 Drawing Sheets

U.S. PATENT DOCUMENTS

| | | | | |
|---|---|---|---|---|
| 6,148,688 | A | 11/2000 | Nishimaki | |
| 6,240,802 | B1 * | 6/2001 | Miller | 74/523 |
| 6,257,645 | B1 | 7/2001 | Kraimer et al. | |
| 6,481,950 | B1 | 11/2002 | Stickney et al. | |
| 6,557,586 | B1 | 5/2003 | Lockyer et al. | |

FOREIGN PATENT DOCUMENTS

| | | | |
|---|---|---|---|
| GB | 866833 | | 5/1961 |
| GB | 1 221 645 | A | 2/1971 |
| GB | 2 299 154 | A | 9/1996 |
| JP | 62 41200 | A | 2/1987 |
| JP | 09 309353 | A | 12/1997 |
| JP | 2003 054894 | A | 2/2003 |

OTHER PUBLICATIONS

Office Action issued in Russian Application No. 2008141456, based on PCT/US2007/064503; Sep. 15, 2010; Russian Patent Office.

* cited by examiner

CONTROL LEVER MECHANISM ADAPTED TO BE MOUNTED TO A COWL OF A MATERIALS HANDLING VEHICLE

This application claims the benefit of U.S. Provisional Application No. 60/784,176, filed Mar. 21, 2006 and entitled "A CONTROL LEVER MECHANISM ADAPTED TO BE MOUNTED TO A COWL OF A MATERIALS HANDLING VEHICLE," the disclosure of which is incorporated herein by reference.

BACKGROUND OF THE INVENTION

It is known to mount a control lever mechanism to a cowl of a materials handling vehicle. The control lever mechanism includes a plurality of control levers, each of which is formed from a tube material and bent by a bending apparatus at appropriate locations to provide a desired lever shape. The tube material bending operations are costly to effect. Also, the diameter of the tube material near an end location, i.e., where a knob is attached, is typically reduced. This reducing operation is also costly. The levers made from the tube material are typically mounted to the vehicle cowl using castings which are bolted to the levers. Because the cowl mounted levers are long, any mounting errors between the bolted-on castings and the levers will adversely change the spacing between the knobs at the opposite ends of the levers.

It is known in the prior art to laser cut deck-mounted control levers. However, those levers are much shorter in length than cowl-mounted control levers.

Accordingly, an improved control lever mechanism adapted to be mounted to a cowl of a materials handling vehicle is desired.

SUMMARY OF THE INVENTION

In accordance with the present invention, an improved control lever mechanism adapted to be mounted to a cowl of a materials handling vehicle is provided. The mechanism includes control levers configured so as to maximize a view zone of an operator. The control levers may be mounted using bosses welded to the levers. Preferably, a pin passes through bores in the bosses as well as bores in a bracket so as to mount the control levers to the vehicle cowl. Hence, bolted on castings may not be employed for mounting the control levers to the vehicle cowl. Further, the control levers may be laser cut from a metal sheet. Hence, costly bending operations for forming bends in tube material are avoided.

In accordance with a first aspect of the present invention, a control lever mechanism is provided for being mounted to a cowl of a main body of a materials handling vehicle. The control lever mechanism may comprise at least one lever structure including a control lever having a section which falls within or is approximately parallel with a lowermost view plane of a view zone of an operator, wherein the operator view zone includes at least one view plane positioned above the lowermost view plane, and apparatus for mounting the lever structure to the main body cowl.

The control lever may have first, second, third and fourth sections. The third section may define the section which falls within or is approximately parallel with the lowermost view plane.

The first and second sections may meet to define a first obtuse angle, the second and third sections may meet to define a second obtuse angle, the third and fourth sections may meet to define a third obtuse angle and the second, third and fourth sections may have approximately a U-shape.

The fourth section may include an operator gripping portion.

A first side surface of the control lever may be positioned in a first plane and a second side surface of the control lever may be positioned in a second plane which is generally parallel to the first plane.

The lever structure may further comprise a support element coupled to an end of the control lever. The support element may have a face positioned in a plane that is angled to a plane containing a side surface of the lever. The support element may comprise a boss coupled to the control lever. The control lever end may include a bore. The boss may extend at least part way through the bore and may be welded to the control lever end.

The lever assembly may further comprise an extension element coupled to the control lever end. The extension element may be coupled to a valve linkage and have a side wall parallel to the face of the support element.

The support element may include a bore and the apparatus for mounting the lever structure to the main body cowl may comprise a bracket coupled to the main body cowl and a pin extending through the bore in the support element and holes or bores in the bracket.

The at least one lever structure may comprise first and second lever structures. The first lever structure may include a first control lever having a section which falls within or is approximately parallel with the lowermost view plane and the second lever structure may include a second control lever having a section which falls within or is approximately parallel with the lowermost view plane.

The first lever structure may further comprise a first support element coupled to an end of the first control lever. The first support element may have a first face positioned at a first angle to a plane containing a side surface of the first lever. The second lever structure may further comprise a second support element coupled to an end of the second control lever. The second support element may comprise a second face positioned at a second angle to a plane containing a side surface of the second lever. The second angle may be greater than the first angle.

Each of the first and second control levers may have first, second, third and fourth sections. The third section may define the section which falls within or is approximately parallel with the lowermost view plane.

The fourth section of the second control lever may have a length that is greater than a length of the fourth section of the first control lever.

The first and second control levers may be laser cut from a solid, generally planar sheet of metal.

In accordance with a second aspect of the present invention, a control lever mechanism is provided for being mounted to a cowl of a main body of a materials handling vehicle. The control lever mechanism may comprise at least one lever structure including a control lever having first, second, third and fourth sections. The second, third and fourth sections may have approximately a U-shape. The fourth section may include an operator gripping portion. The control lever mechanism may further include apparatus for mounting the lever structure to the main body cowl.

The lever structure may further comprise a support element coupled to an end of the control lever having a face positioned in a plane that is angled to a plane containing a side surface of the control lever.

In accordance with a third aspect of the present invention, a control lever mechanism is provided adapted to be mounted to a cowl of a main body of a materials handling vehicle. The control lever mechanism may comprise at least one lever structure including a control lever and a support element coupled to an end of the control lever. The support element may have a face positioned in a plane that is angled to a plane containing a side surface of the control lever. The control lever mechanism may further include apparatus for mounting the lever structure to the main body cowl.

The support element may comprise a boss coupled to the control lever. The control lever end may include a bore and the boss may extend at least part way through the bore and be welded to the lever end.

The lever assembly may further comprise an extension element coupled to the control lever end and be adapted to be coupled to a valve linkage. The extension element may have a side wall parallel to the face of the support element.

The at least one lever structure may comprise first and second lever structures having first and second control levers, respectively. The first lever structure may further comprise a first support element coupled to an end of the first control lever. The first support element may have a first face positioned at a first angle to a plane containing a side surface of the first lever. The second lever structure may further comprise a second support element coupled to an end of the second control lever. The second support element may have a second face positioned at a second angle to a plane containing a side surface of the second lever. The second angle may be greater than the first angle.

DETAILED DESCRIPTION OF THE INVENTION

Figure 1:
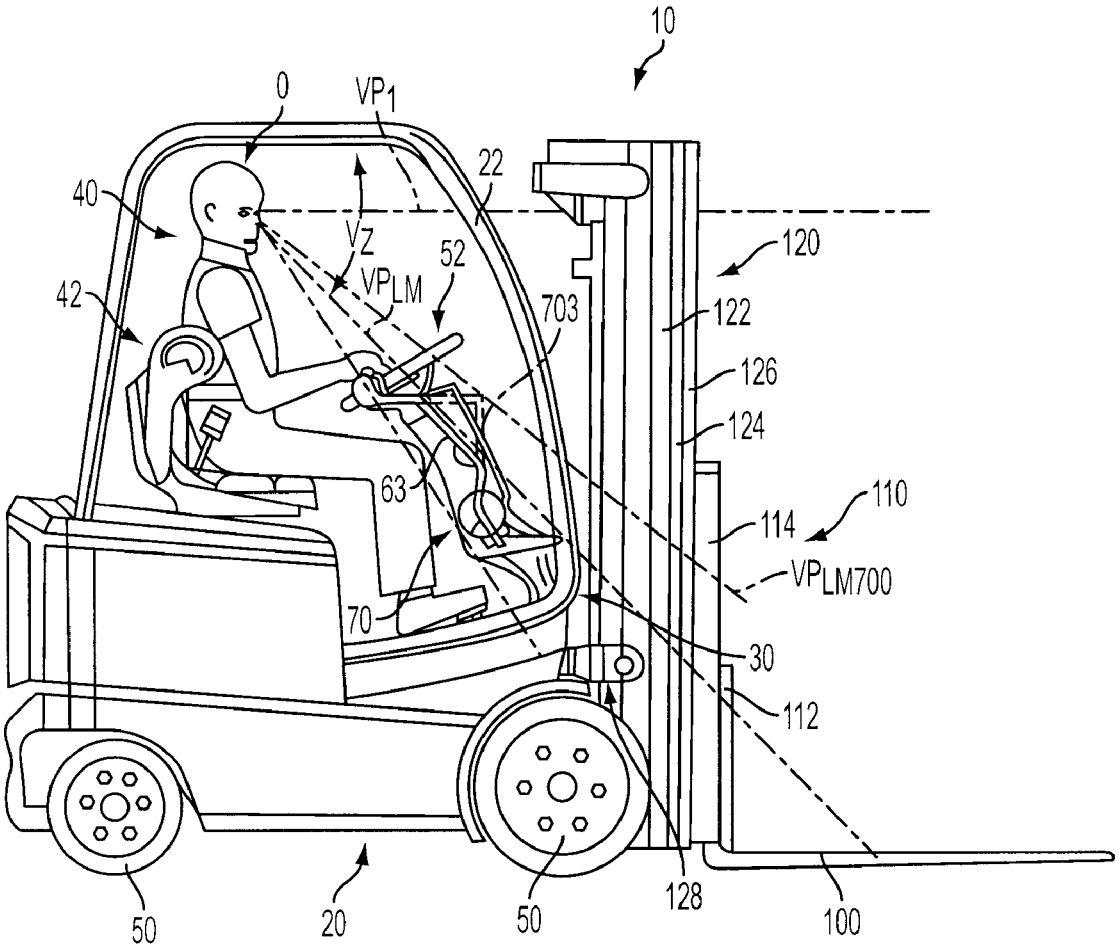
FIG. 1 is a side view of a materials handling vehicle including a control lever mechanism constructed in accordance with the present invention.
Figure 1A:
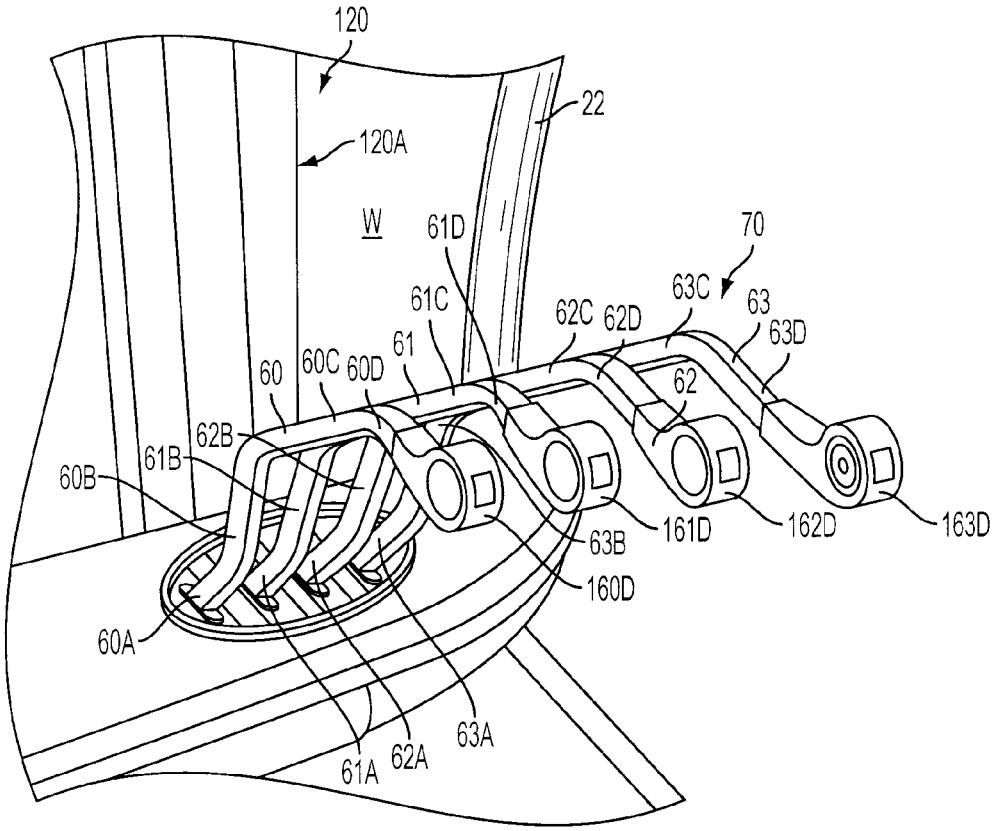
FIG. 1A is a perspective view of the control lever mechanism.

Reference is now made to FIG. 1, which illustrates a materials handling vehicle comprising a fork lift truck 10. The truck 10 comprises a main body or frame 20 having a cowl 30 located forward of an operator's compartment 40 and near an A-post 22 of the main body 20, i.e., the cowl 30 is the front portion of the main body 20 located forward of the operator's compartment 40 and adjacent the A-post 22. The truck 10 further includes four wheels 50 (only two of which are illustrated in FIG. 1). At least one wheel 50 is driven and at least one wheel 50 is steerable. The operator's compartment 40 comprises a seat 42 for receiving an operator O. Extending into the operator's compartment is a steering wheel 52 for effecting steering of the steerable wheel(s). Also extending into the operator's compartment 40 are first, second, third and fourth control levers 60-63, respectively, which form part of a control lever mechanism 70 of the present invention, see FIG. 1A. The control lever mechanism 70 is mounted to the cowl 30 of the main body 20. The control lever mechanism 70 is also coupled to a valve apparatus 72, see FIGS. 2 and 3.

A pair of forks 100 are mounted on a fork carriage mechanism 110 that includes a fork carriage 112 and a load backrest 114. The forks 100 are coupled to the fork carriage 112 which, in turn, is coupled to an extensible mast assembly 120. The load backrest 114 is coupled to the fork carriage 112. The mast assembly 120 includes a pivotable mast member 122 that does not move vertically and first and second nested mast members 124 and 126, which are coupled to and capable of vertical movement relative to the mast member 122. The mast member 122 is pivotably coupled to the main body 20, while the fork carriage 112 is coupled to the second movable mast member 126. The mast assembly 120 includes a plurality of hydraulic cylinders (not shown) for effecting vertical movement of the mast members 124 and 126. Further, hydraulic piston/cylinder units 128 (only one is shown in FIG. 1) are coupled to the main body 20 and the mast member 122 for tilting mast members 122, 124 and 126 toward and away from the truck 10 about a substantially horizontal axis. In the illustrated embodiment, a first auxiliary device (not shown) is provided between the mast assembly 120 and the carriage mechanism 110 for moving the carriage mechanism 110 and the forks 100 from side to side, i.e., in and out of the paper in FIG. 1, and a second auxiliary device (not shown) is provided which may perform a function such as varying the distance between the forks, i.e., either moving the forks closer together or further apart.

Figure 2:
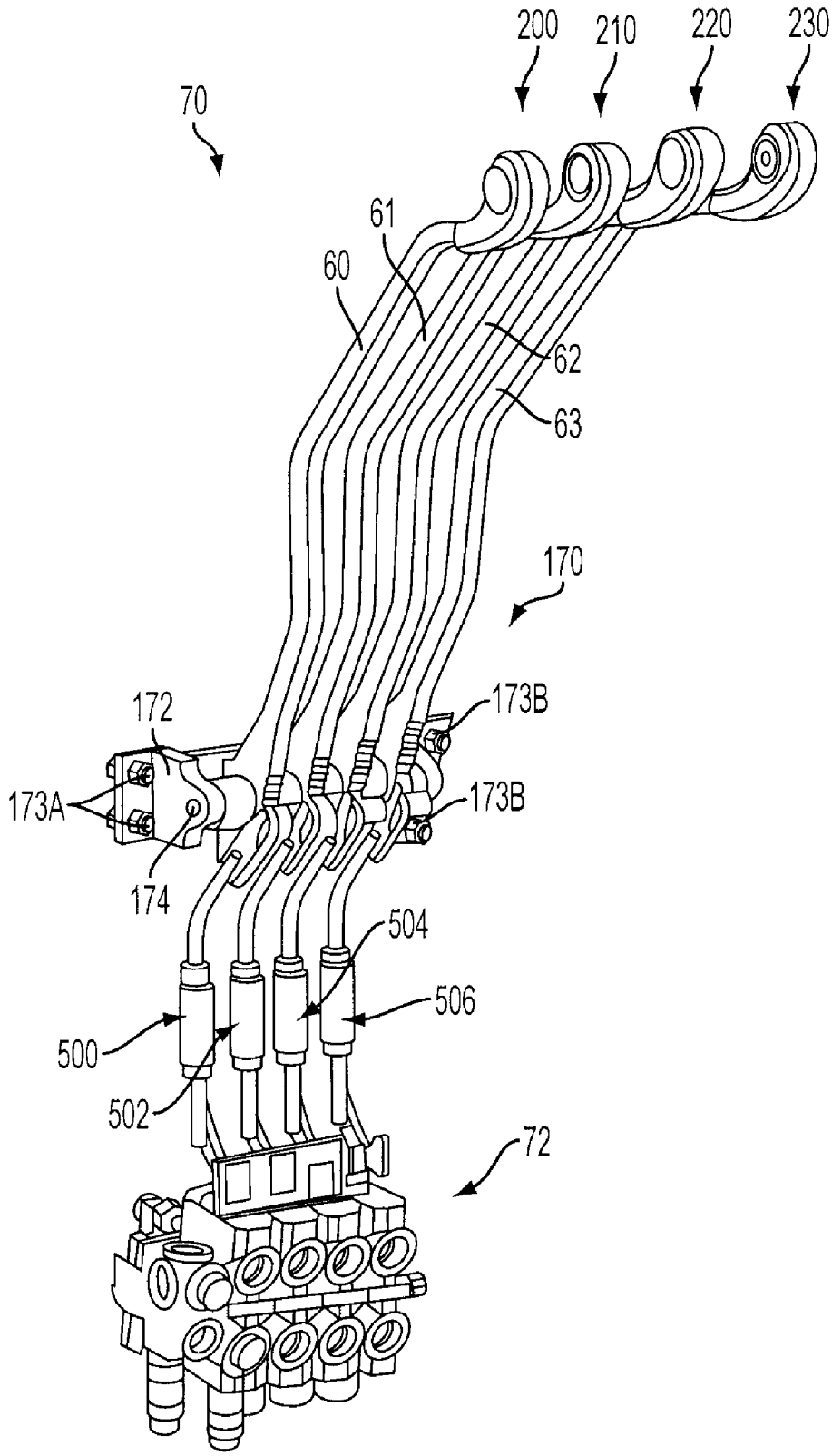
FIG. 2 is a perspective view of the control lever mechanism and valve apparatus of the vehicle illustrated in FIG. 1.
Figure 3:
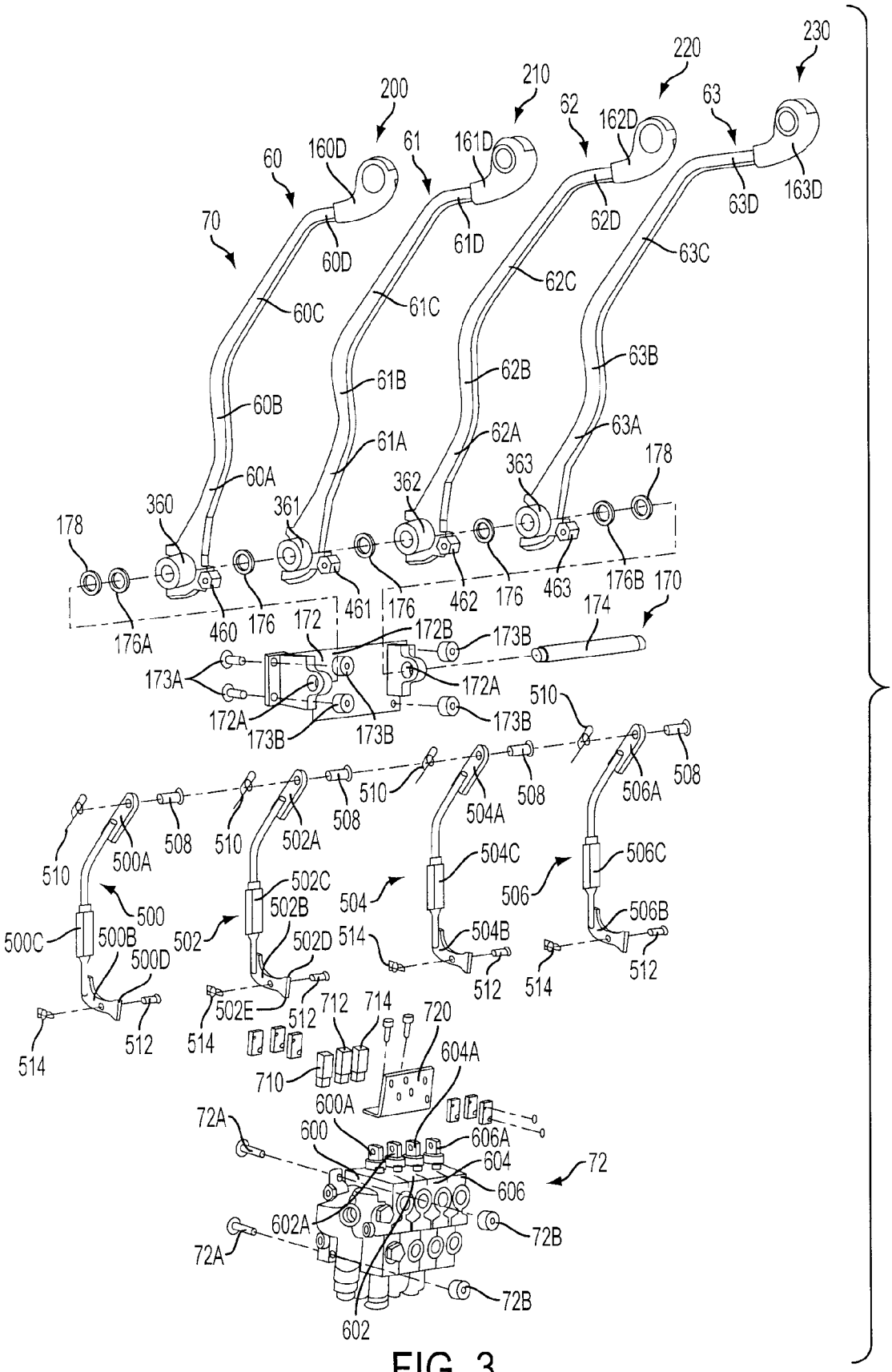
FIG. 3 is an exploded view of the control lever mechanism and valve apparatus illustrated in FIG. 2.
Figure 7:
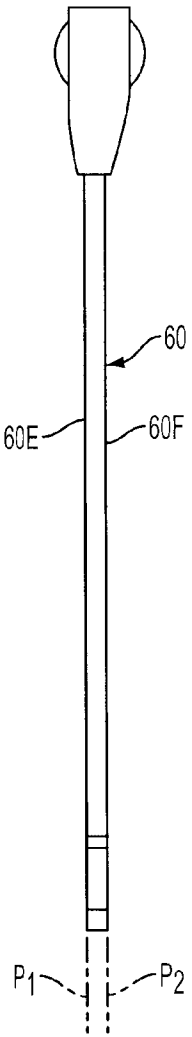
FIG. 7 is a view of the first control lever, wherein the first control lever has been rotated from its position illustrated in FIG. 6.

Referring now to FIGS. 2 and 3, the illustrated control lever mechanism 70 includes first, second, third and fourth lever structures 200, 210, 220 and 230, respectively. The first lever structure 200 comprises the first control lever 60. The first lever 60 is preferably laser cut from a planar steel plate and has first, second, third and fourth sections, 60A-60D, respectively, see FIGS. 3 and 4. As is apparent from FIG. 4, the first and second sections 60A and 60B meet to define a first obtuse angle $\Theta_1$, the second and third sections 60B and 60C meet to define a second obtuse angle $\Theta_2$, and the third and fourth sections 60C and 60D meet to define a third obtuse angle $\Theta_3$. The second, third and fourth sections 60B-60D of the first control lever 60 have approximately a U-shape, see FIGS. 3, 4 and 6. In the illustrated embodiment, a first knob 160D formed from a polymeric material may be molded onto the fourth section 60D and defines a gripping portion for the fourth section 60D, see FIG. 3. A first side surface 60E of the control lever 60 may be positioned in a first plane $P_1$ and a second side surface 60F of the control lever 60 may be positioned in a second plane $P_2$ which is generally parallel to the first plane $P_1$, see FIG. 7.

Figure 8:
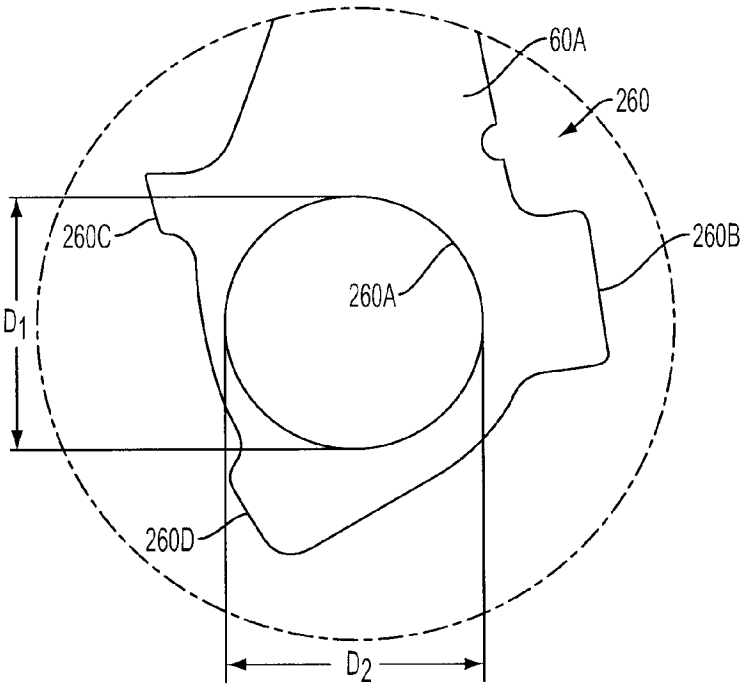
FIG. 8 is an enlarged view of an end of a first section of the first control lever.
Figure 6:
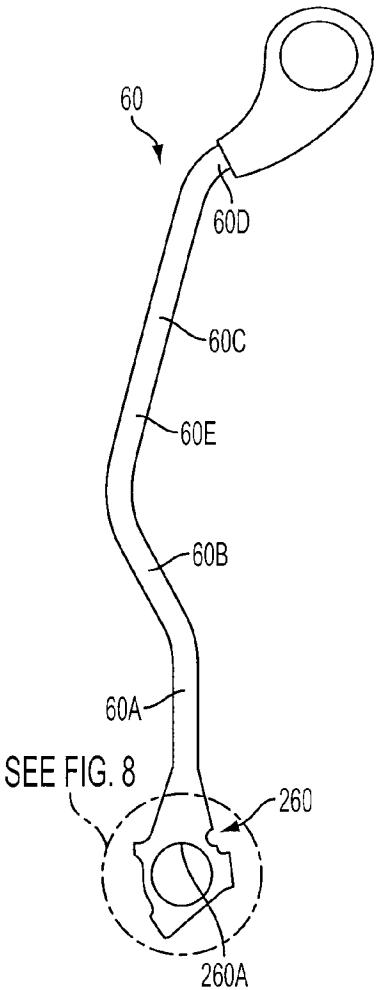
FIG. 6 is a side view of the first control lever.
Figure 9:
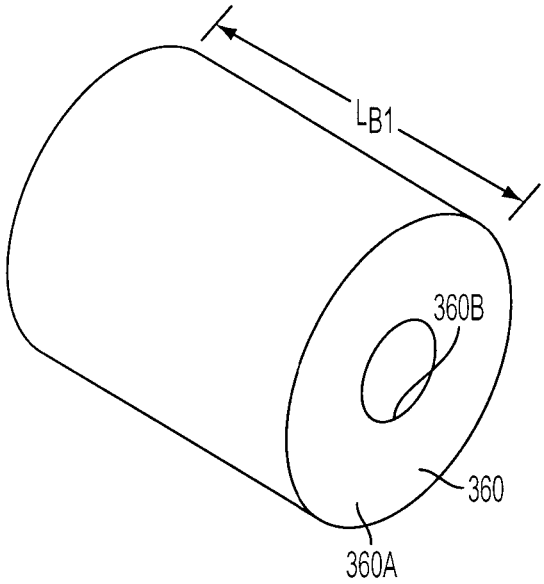
FIG. 9 is a perspective view of a boss to be inserted into a bore provided in the end of the first section of the first control lever and welded to the first control lever.
Figure 12:
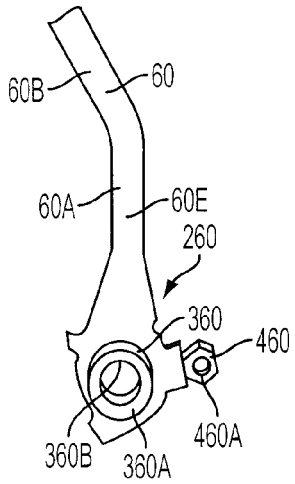
FIG. 12 is a side view of the first section of the first control lever and a corresponding boss and extension.

A bore 260A is provided in an end 260 of the first section 60A of the first control lever 60, see FIGS. 6 and 8. A support element comprising a generally cylindrical boss 360 is inserted into the bore 260A and welded to the end 260, see FIGS. 12-14. The boss 360 may have a length $L_{B1}$ of about 43 mm, see FIG. 9. In the illustrated embodiment, the boss 360 is angled within the bore 260A such that a first outer face 360A of the boss 360 defines an angle $\alpha_1$ of about 6.8 degrees with the first side surface 60E of the control lever 60, see FIG. 13. The boss 360 is then welded to the control lever 60. After the welding operation, the first outer face 360A of the boss 360 is machined to ensure that the outer face 360A is extending at the angle $\alpha_1$ of about 6.8 degrees with the first side surface 60E of the control lever 60. An opposing second outer face 360C of the boss 360 may also be machined to the angle $\alpha_1$. However, this latter machining operation of the second outer face 360C may not be necessary. After the boss first outer face 360A is machined, a bore 360B is machined completely through the boss 360. An axis of the bore 360B extends at an angle of about 90 degrees to the machined first outer face 360A of the boss 360. The bore 260A in the end 260 of the first section 60A of the first control lever 60 is slightly elliptical in shape, i.e., axis $D_1$ is slightly greater in length than axis $D_2$, see FIG. 8, so as to accommodate the angularly oriented boss 360.

Figure 13:
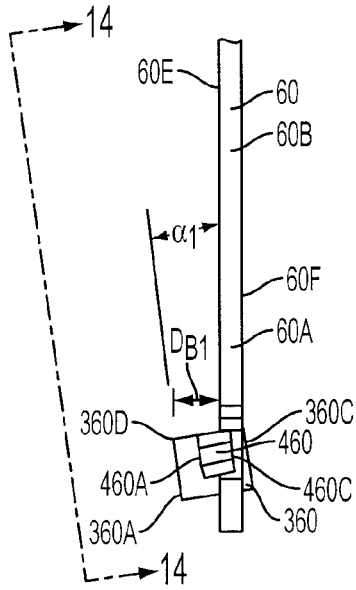
FIG. 13 is a view of the first section of the first control lever and the corresponding boss and extension rotated from the position illustrated in FIG. 12.

Also in the illustrated embodiment, an outermost point 360D on the boss 360 is positioned a distance $D_{B1}$ of approximately 26.8 mm from the first side surface 60E of the control lever 60, see FIG. 13.

Figure 10:
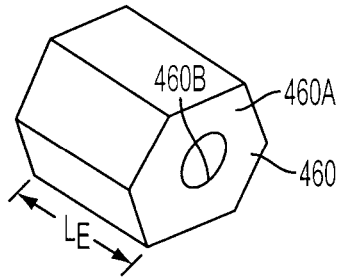
FIG. 10 is a perspective view of a first extension element to be welded to the end of the first section of the first control lever.

The end 260 of the first section 60A of the first control lever 60 includes first, second and third substantially planar faces 260B, 260C and 260D. A first extension element 460 is welded to the first face 260B, see FIGS. 12-14. The extension element 460 is generally hexagonal in shape, see FIG. 10. Prior to being welded, the first extension element 460 is positioned relative to the first face 260B such that a first outer face 460A of the extension element 460 is substantially parallel to the first outer face 360A of the boss 360. After the first extension element 460 is welded to the end 260, the first outer face 460A of the extension element 460 is machined to ensure that the first outer face 460A is substantially parallel to the first outer face 360A of the boss 360. An opposing second outer face 460C of the extension element 460 may also be machined so as to be parallel with the first outer face 460A. However, this latter machining operation of the second outer face 460C may not be necessary. After the extension first outer face 460A is machined, a bore 460B is machined completely through the extension element 460. An axis of the bore 460B extends at an angle of about 90 degrees to the machined first outer face 460A of the extension element 460.

Further in the illustrated embodiment, the first outer face 360A of the boss 360 is spaced approximately 14.7 mm from the first outer face 460A of the extension element 460. The extension element 460 has a length $L_E$ of about 18.1 mm, see FIG. 10.

Figure 16:
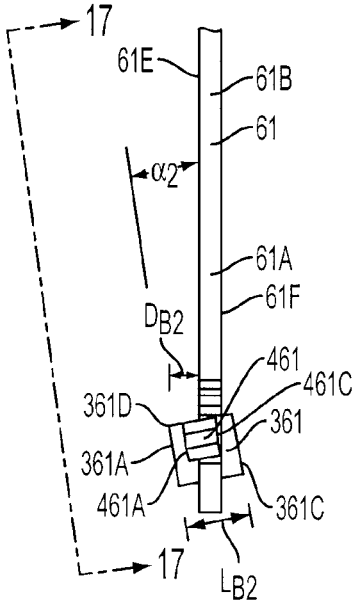
FIG. 16 is a view of the first section of the second control lever and the corresponding boss and extension rotated from the position illustrated in FIG. 15.

The second lever structure 210 comprises the second control lever 61. The second lever 61 is preferably laser cut from a planar steel plate and has first, second, third and fourth sections, 61A-61D, respectively, see FIG. 3. As is apparent from FIG. 3, the first and second sections 61A and 61B meet to define a first obtuse angle, the second and third sections 61B and 61C meet to define a second obtuse angle, and the third and fourth sections 61C and 61D meet to define a third obtuse angle. The second, third and fourth sections 61B-61D of the second control lever 61 have approximately a U-shape, see FIG. 3. In the illustrated embodiment, a second knob 161D formed from a polymeric material may be molded onto the fourth section 61D and defines a gripping portion for the fourth section 61D, see FIG. 3. A first side surface 61E of the control lever 61 may be positioned in a plane which is generally parallel with a plane in which a second side surface 61F of the control lever 61 is positioned, see FIG. 16.

Figure 15:
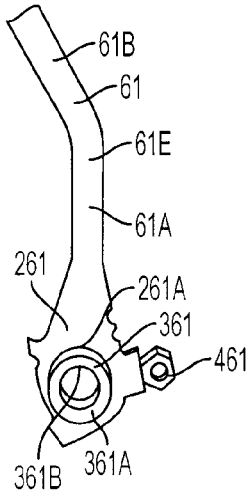
FIG. 15 is a side view of the first section of the second control lever and a corresponding boss and extension.
Figure 17:
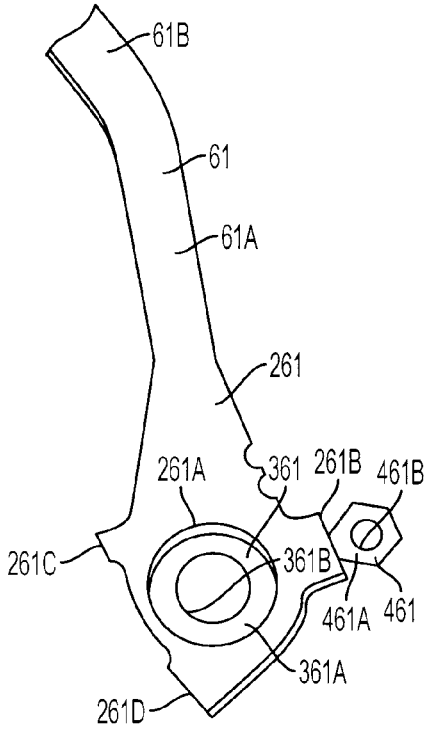
FIG. 17 is a view taken along view line 17-17 in FIG. 16.

A bore 261A is provided in an end 261 of the first section 61A of the second control lever 61, see FIGS. 15 and 17. A support element comprising a generally cylindrical boss 361 is inserted into the bore 261A and welded to the end 261, see FIGS. 15-17. The boss 361 may have a length $L_{B2}$ of about 38 mm, see FIG. 16. In the illustrated embodiment, the boss 361 is angled within the bore 261A such that a first outer face 361A of the boss 361 defines an angle $\alpha_2$ of about 9.6 degrees with the first side surface 61E of the control lever 61, see FIG. 16. The boss 361 is then welded to the control lever 61. After the welding operation, the first outer face 361A of the boss 361 is machined to ensure that the outer face 361A is extending at the angle $\alpha_2$ of about 9.6 degrees with the first side surface 61E of the control lever 61. An opposing second outer face 361C of the boss 360 may also be machined to the angle $\alpha_2$. However, this latter machining operation of the second outer face 361C may not be necessary. After the boss first outer face 361A is machined, a bore 361B is machined through the boss 361. An axis of the bore 361B extends at an angle of about 90 degrees to the machined first outer face 361A of the boss 361. The bore 261A in the end 261 of the first section 61A of the second control lever 61 is slightly elliptical in shape so as to accommodate the angularly oriented boss 361.

Also in the illustrated embodiment, an outermost point 361D on the boss 361 is positioned a distance $D_{B2}$ of approximately 17 mm from the first side surface 61E of the control lever 61.

The end 261 of the first section 61A of the second control lever 61 includes first, second and third substantially planar faces 261B, 261C and 261D, see FIG. 17. A second extension element 461 is welded to the first face 261B, see FIGS. 15-17. The extension element 461 is generally hexagonal in shape. Prior to being welded, the extension element 461 is positioned relative to the first face 261B such that a first outer face 461A of the extension element 461 is substantially parallel to the first outer face 361A of the boss 361. After the second extension element 461 is welded to the end 261, the first outer face 461A of the extension element 461 is machined to ensure that the first outer face 461A is substantially parallel to the first outer face 361A of the boss 361. An opposing second outer face 461C of the extension element 461 may also be machined so as to be parallel with the first outer face 461A. However, this latter machining operation of the second outer face 461C may not be necessary. After the extension first outer face 461A is machined, a bore 461B is machined through the extension element 461. An axis of the bore 461B extends at an angle of about 90 degrees to the machined first outer face 461A of the extension element 461.

Further in the illustrated embodiment, the first outer face 361A of the boss 361 is spaced approximately 7.8 mm from the first outer face 461A of the extension element 461. The extension element 461 has a length of about 18.2 mm.

Figure 19:
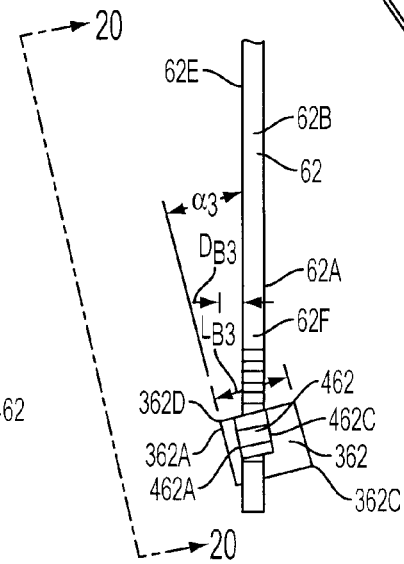
FIG. 19 is a view of the first section of the third control lever and the corresponding boss and extension rotated from the position illustrated in FIG. 18.

The third lever structure 220 comprises the third control lever 62. The third control lever 62 is preferably laser cut from a planar steel plate and has first, second, third and fourth sections, 62A-62D, respectively, see FIG. 3. As is apparent from FIG. 3, the first and second sections 62A and 62B meet to define a first obtuse angle, the second and third sections 62B and 62C meet to define a second obtuse angle, and the third and fourth sections 62C and 62D meet to define a third obtuse angle. The second, third and fourth sections 62B-62D of the third control lever 62 have approximately a U-shape, see FIG. 3. In the illustrated embodiment, a third knob 162D formed from a polymeric material may be molded onto the fourth section 62D and defines a gripping portion for the fourth section 62D, see FIG. 3. A first side surface 62E of the control lever 62 may be positioned in a plane which is generally parallel with a plane in which a second side surface 62F of the control lever 62 is positioned, see FIG. 19.

Figure 18:
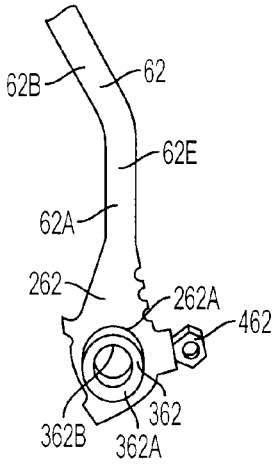
FIG. 18 is a side view of the first section of a third control lever and a corresponding boss and extension.
Figure 20:
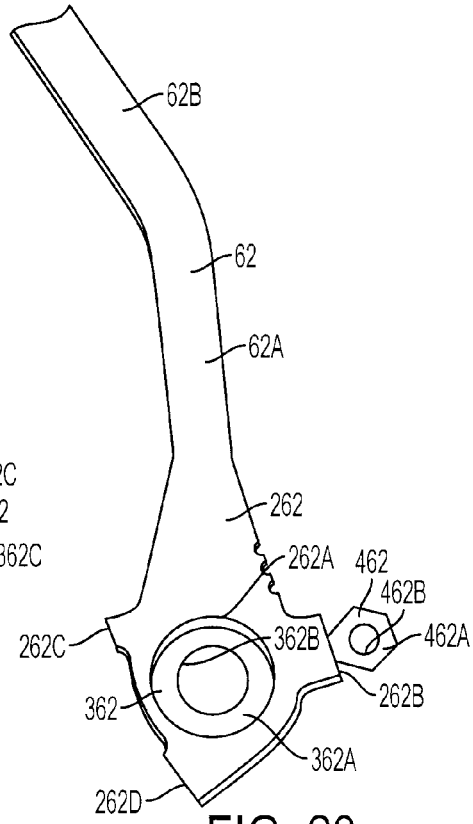
FIG. 20 is a view taken along view line 20-20 in FIG. 19.

A bore 262A is provided in an end 262 of the first section 62A of the third control lever 62, see FIGS. 18 and 20. A support element comprising a generally cylindrical boss 362 is inserted into the bore 262A and welded to the end 262, see FIGS. 18-20. The boss 362 may have a length $L_{B3}$ of about 38 mm. In the illustrated embodiment, the boss 362 is angled within the bore 262A such that a first outer face 362A of the boss 362 defines an angle $\alpha_3$ of about 12.4 degrees with the first side surface 62E of the control lever 62, see FIG. 19. The boss 362 is then welded to the control lever 62. After the welding operation, the first outer face 362A of the boss 362 is machined to ensure that the outer face 362A is extending at the angle $\alpha_3$ of about 12.4 degrees with the first side surface 62E of the control lever 62. An opposing second outer face 362C of the boss 362 may also be machined to the angle $\alpha_3$. However, this latter machining operation of the second outer face 362C may not be necessary. After the boss first outer face 362A is machined, a bore 362B is machined through the boss 362. An axis of the bore 362B extends at an angle of about 90 degrees to the machined first outer face 362A of the boss 362. The bore 262A in the end 262 of the first section 62A of the third control lever 62 is slightly elliptical in shape so as to accommodate the angularly oriented boss 362.

Also in the illustrated embodiment, an outermost point 362D on the boss 362 is positioned a distance $D_{B3}$ of approximately 13 mm from the first side surface 62E of the control lever 62.

The end 262 of the first section 62A of the third control lever 62 includes first, second and third substantially planar faces 262B, 262C and 262D. A third extension element 462 is welded to the first face 262B, see FIGS. 18-20. The extension element 462 is generally hexagonal in shape. Prior to being welded, the extension element 462 is positioned relative to the first face 262B such that a first outer face 462A of the extension element 462 is substantially parallel to the first outer face 362A of the boss 362. After the third extension element 462 is welded to the end 262, the first outer face 462A of the extension element 462 is machined to ensure that the first outer face 462A is substantially parallel to the first outer face 362A of the boss 362. An opposing second outer face 462C of the extension element 462 may also be machined so as to be parallel with the first outer face 462A. However, this latter machining operation of the second outer face 462C may not be necessary. After the extension first outer face 462A is machined, a bore 462B is machined through the extension element 462. An axis of the bore 462B extends at an angle of about 90 degrees to the machined first outer face 462A of the extension element 462.

Further in the illustrated embodiment, the first outer face 362A of the boss 362 is spaced approximately 5.9 mm from the first outer face 462A of the extension element 462. The extension element 462 has a length of about 18.2 mm.

Figure 22:
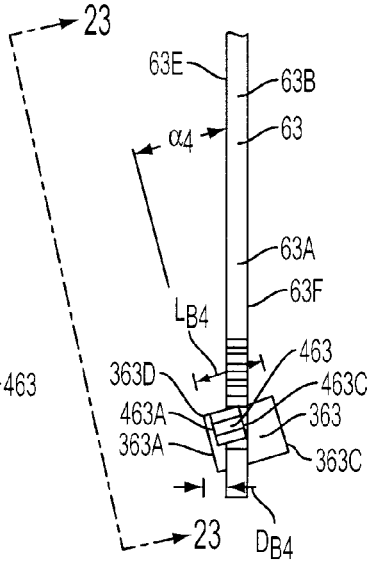
FIG. 22 is a view of the first section of the fourth control lever and the corresponding boss and extension rotated from the position illustrated in FIG. 21.

The fourth lever structure 230 comprises the fourth control lever 63. The fourth control lever 63 is preferably laser cut from a planar steel plate and has first, second, third and fourth sections, 63A-63D, respectively, see FIG. 3. As is apparent from FIG. 3, the first and second sections 63A and 63B meet to define a first obtuse angle, the second and third sections 63B and 63C meet to define a second obtuse angle, and the third and fourth sections 63C and 63D meet to define a third obtuse angle. The second, third and fourth sections 63B-63D of the fourth control lever 63 have approximately a U-shape, see FIG. 3. In the illustrated embodiment, a fourth knob 163D formed from a polymeric material may be molded onto the fourth section 63D and defines a gripping portion for the fourth section 63D, see FIG. 3. A first side surface 63E of the control lever 63 may be positioned in a plane which is generally parallel with a plane in which a second side surface 63F of the control lever 63 is positioned, see FIG. 22.

Figure 21:
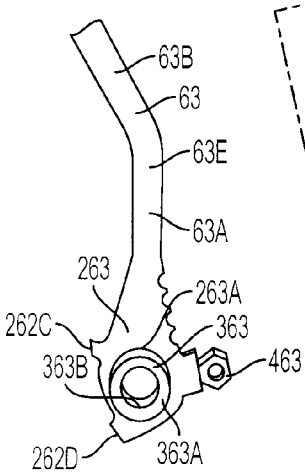
FIG. 21 is a side view of the first section of a fourth control lever and a corresponding boss and extension.
Figure 23:
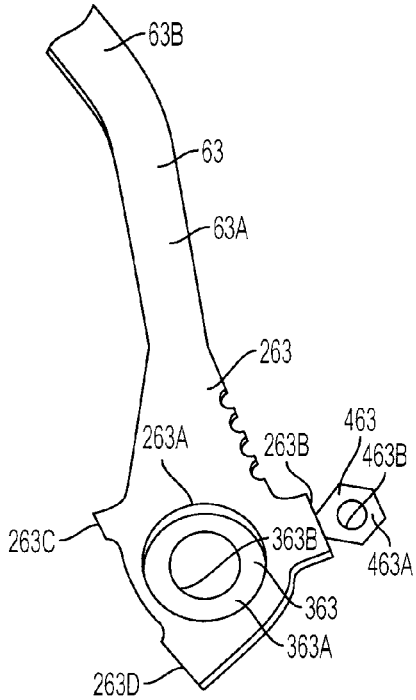
FIG. 23 is a view taken along view line 23-23 in FIG. 22.

A bore 263A is provided in an end 263 of the first section 63A of the fourth control lever 63, see FIGS. 21 and 23. A support element comprising a generally cylindrical boss 363 is inserted into the bore 263A and welded to the end 263, see FIGS. 21-23. The boss 363 may have a length $L_{B4}$ of about 42 mm. In the illustrated embodiment, the boss 363 is angled within the bore 263A such that a first outer face 363A of the boss 363 defines an angle $\alpha_4$ of about 14.8 degrees with the first side surface 63E of the control lever 63, see FIG. 22. The boss 363 is then welded to the control lever 63. After the welding operation, the first outer face 363A of the boss 363 is machined to ensure that the outer face 363A is extending at the angle $\alpha_4$ of about 14.8 degrees with the first side surface 63E of the control lever 63. An opposing second outer face 363C of the boss 363 may also be machined to the angle $\alpha_4$. However, this latter machining operation of the second outer face 363C may not be necessary. After the boss first outer face 363A is machined, a bore 363B is machined through the boss 363. An axis of the bore 363B extends at an angle of about 90 degrees to the machined first outer face 363A of the boss 363. The bore 263A in the end 263 of the first section 63A of the fourth control lever 63 is slightly elliptical in shape so as to accommodate the angularly oriented boss 363.

Also in the illustrated embodiment, an outermost point 363D on the boss 363 is positioned a distance $D_{B4}$ of approximately 10.6 mm from the first side surface 63E of the control lever 63.

The end 263 of the first section 63A of the fourth control lever 63 includes first, second and third substantially planar faces 263B, 263C and 263D. A fourth extension element 463 is welded to the first face 263B, see FIGS. 21-23. The extension element 463 is generally hexagonal in shape. Prior to being welded, the extension element 463 is positioned relative to the first face 263B such that a first outer face 463A of the extension element 463 is substantially parallel to the first outer face 363A of the boss 363. After the fourth extension element 463 is welded to the end 263, the first outer face 463A of the extension element 463 is machined to ensure that the first outer face 463A is substantially parallel to the first outer face 363A of the boss 363. An opposing second outer face 463C of the extension element 463 may also be machined so as to be parallel with the first outer face 463A. However, this latter machining operation of the second outer face 463C may not be necessary. After the extension first outer face 463A is machined, a bore 463B is machined through the extension element 463. An axis of the bore 463B extends at an angle of about 90 degrees to the machined first outer face 463A of the extension element 463.

Further in the illustrated embodiment, the first outer face 363A of the boss 363 is spaced approximately 3.8 mm from the first outer face 463A of the extension element 463. The extension element 463 has a length of about 18.4 mm.

The control lever mechanism 70 further includes apparatus 170 for mounting the first, second, third and fourth lever structures 200, 210, 220 and 230 to the cowl 30 of the truck main body 20. The mounting apparatus 170 comprises a bracket 172 and a pin 174, see FIG. 3. The bracket 172 is coupled to the cowl 30 via bolts 173A and nuts 173B, see also FIGS. 2 and 4. Positioned on opposing sides of the bosses 360-363 are spring washers 176, see FIG. 3. Positioned adjacent to a first spring washer 176A and a final spring washer 176B are flat washers 178.

To assembly the first, second, third and fourth lever structures 200, 210, 220 and 230 to the bracket 172, the pin 174 is extended through the spring washers 176, the flat washers 178 and the bores 360B, 361B, 362B and 363B of the bosses 360-363, see FIG. 3. As illustrated in FIGS. 2 and 3, the second lever structure 210 is positioned adjacent to the first lever structure 200, the third lever structure 220 is positioned adjacent to the second lever structure 210 and the fourth lever structure 230 is positioned adjacent to the third lever structure 220. The pin 174 also passes through bores 172A in the bracket 172. The pin 174 may be held in the bores 172A via a friction-fit arrangement or clips (not shown). The bosses 360-363 are capable of rotating relative to the pin 174.

Figure 4:
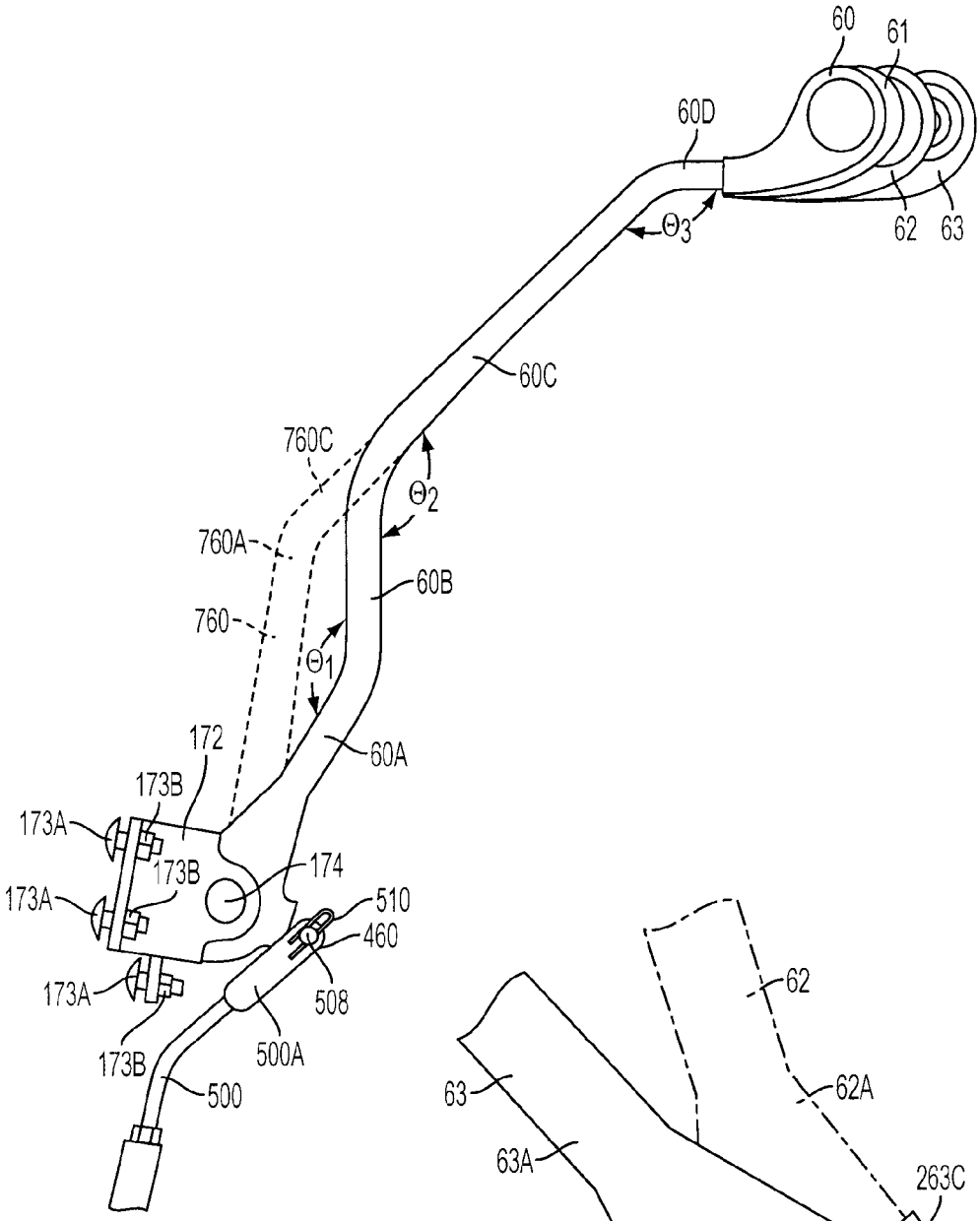
FIG. 4 is a side view of the control lever mechanism.
Figure 5:
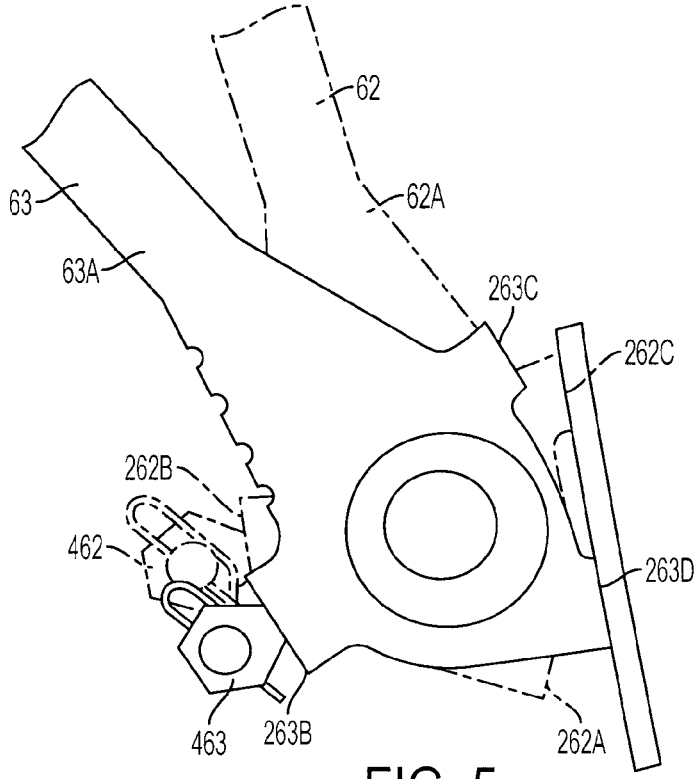
FIG. 5 is a side view of first sections of control levers and a bracket to which the control levers are mounted, wherein one control lever section is shown in phantom.

As is apparent from FIG. 4, the first, second, third and fourth control levers 60-63 are generally aligned when viewed from the side. However, to allow easy access to the second, third and fourth control levers 61-63 by an operator O sitting in the seat 42, the fourth section 61D of the second control lever 61 is slightly longer than the fourth section 60D of the first control lever 60, the fourth section 62D of the third control lever 62 is slightly longer than the fourth section 61D of the second control lever 61, and the fourth section 63D of the fourth control lever 63 is slightly longer than the fourth section 62D of the third control lever 62, see FIG. 1A.

As noted above, the control lever mechanism 70 is coupled to a valve apparatus 72, see FIGS. 2 and 3. First, second, third and fourth valve linkages 500, 502, 504 and 506, respectively, are provided for coupling the first, second, third and fourth lever structures 200, 210, 220, and 230 of the control lever mechanism 70 to first, second, third and fourth spool valves 600, 602, 604 and 606, respectively, forming part of the valve apparatus 72. First ends 500A, 502A, 504A and 506A of the linkages 500, 502, 504 and 506 are coupled via pins 508 and clips 510 to the first, second, third and fourth extensions 460-463 of the first, second, third and fourth lever structures 200, 210, 220 and 230. Second ends 500B, 502B, 504B and 506B of the linkages 500, 502, 504 and 506 are coupled via pins 512 and clips 514 to first, second, third and fourth valve extensions 600A, 602A, 604A and 606A of the valves 600, 602, 604 and 606. The distance between the first and second ends 500A and 500B of the first linkage 500 may be varied via a turnbuckle 500C; the distance between the first and second ends 502A and 502B of the second linkage 502 may be varied via a turnbuckle 502C; the distance between the first and second ends 504A and 504B of the third linkage 504 may be varied via a turnbuckle 504C; and the distance between the first and second ends 506A and 506B of the fourth linkage 506 may be varied via a turnbuckle 506C.

Preferably, the spacing between the first ends 500A, 502A, 504A and 506A of the linkages 500, 502, 504 and 506 is substantially equal to the spacing between the valve extensions 600A, 602A, 604A and 606A. However, the spacing between the knobs 160D, 161D, 162D and 163D provided on the fourth sections 60D, 61D, 62D and 63D of the first, second, third and fourth control levers 60-63 is preferably greater than the spacing between the first ends 500A, 502A, 504A and 506A of the linkages 500, 502, 504 and 506 so as to ergonomically enhance the arrangement of the knobs 160D, 161D, 162D and 163D relative to the operator O. The increase in the spacing between the knobs 160D, 161D, 162D and 163D as compared to the spacing between the extensions 460-463, which defines the spacing between the first ends 500A, 502A, 504A and 506A of the linkages 500, 502, 504 and 506, results due to the varying angles $\alpha_1$, $\alpha_2$, $\alpha_3$, and $\alpha_4$ of the first faces 360A-363A of the bosses 360-363 relative to the first side surfaces 60E, 61E, 62E and 63E of the control levers 60-63, the lengths $L_{B1}$, $L_{B2}$, $L_{B3}$, and $L_{B4}$ of the bosses 360-363 and the distances between the outermost points 360D, 361D, 362D and 363D on the bosses 360-363 and the first side surfaces 60E, 61E, 62E and 63E of the control levers 60-63.

The first valve 600 may control the height of the forks 100, the second valve 602 may control the tilt of the mast assembly 120, the third valve 604 may control side shift of the carriage mechanism 110 and the forks 100 and the fourth valve 606 may control the distance between the forks 100. To control the operation of the spool valves 600, 602, 604 and 606, the first, second, third and fourth lever structures 200, 210, 220 and 230 are rotated clockwise or counter-clockwise, as viewed in FIG. 4. For example, when the first knob 160D is pushed in a direction away from the operator O, the forks 100 may be lowered and when the first knob 160D is pulled toward the operator O, the forks 100 may be raised. When the second knob 161D is pushed in a direction away from the operator O, the mast assembly 120 may tilt away from the operator O and when the second knob 161D is pulled toward the operator O, the mast assembly 120 may tilt toward the operator O. When the third knob 162D is pushed in a direction away from the operator O, the carriage mechanism 110 and forks 100 may shift to the left and when the third knob 162D is pulled in a direction toward the operator, the carriage mechanism 110 and forks 100 may shift to the right. When the fourth knob 163D is pushed in a direction away from the operator O, the forks may move further apart and when the fourth knob 163D is pulled in a direction toward the operator, the forks may move closer together.

Figure 14:
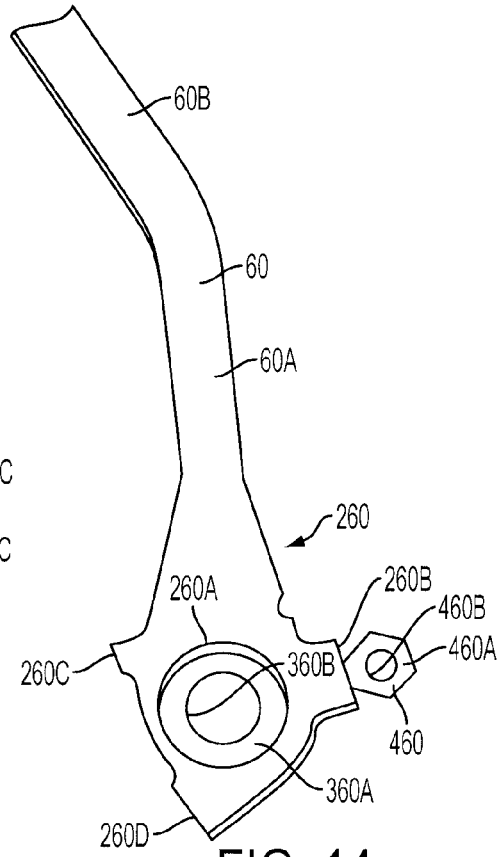
FIG. 14 is a view taken along view line 14-14 in FIG. 13.

The second face 260C on the end 260 of the first section 60A of the first lever 60 defines a first stop that engages a center plate 172B of the bracket 172 so as to prevent an operator O from pushing the first lever 60 too far in a direction away from the operator O and damaging the valve 600, see FIGS. 3, 8 and 14. The third face 260D on the end 260 of the first section 60A of the first lever 60 defines a second stop that engages the center plate 172B of the bracket 172 so as to prevent an operator O from pulling the first lever 60 too far in a direction toward the operator O and damaging the valve 600. In a similar manner, the second faces 261C, 262C and 263C on the second, third and fourth levers 61-63 define first stops that engage the center plate 172B of the bracket 172 so as to prevent an operator O from pushing those levers 61-63 too far in a direction away from the operator O and damaging the valves 602, 604 and 606, see FIGS. 3, 5, 17, 20 and 23. The third faces 261D, 262D and 263D on the ends 261-263 of the second, third and fourth levers 61-63 define second stops that engage the center plate 172B of the bracket 172 so as to prevent an operator O from pulling the levers 61-63 too far in a direction toward the operator O and damaging the valves 602, 604 and 606.

Figure 11:
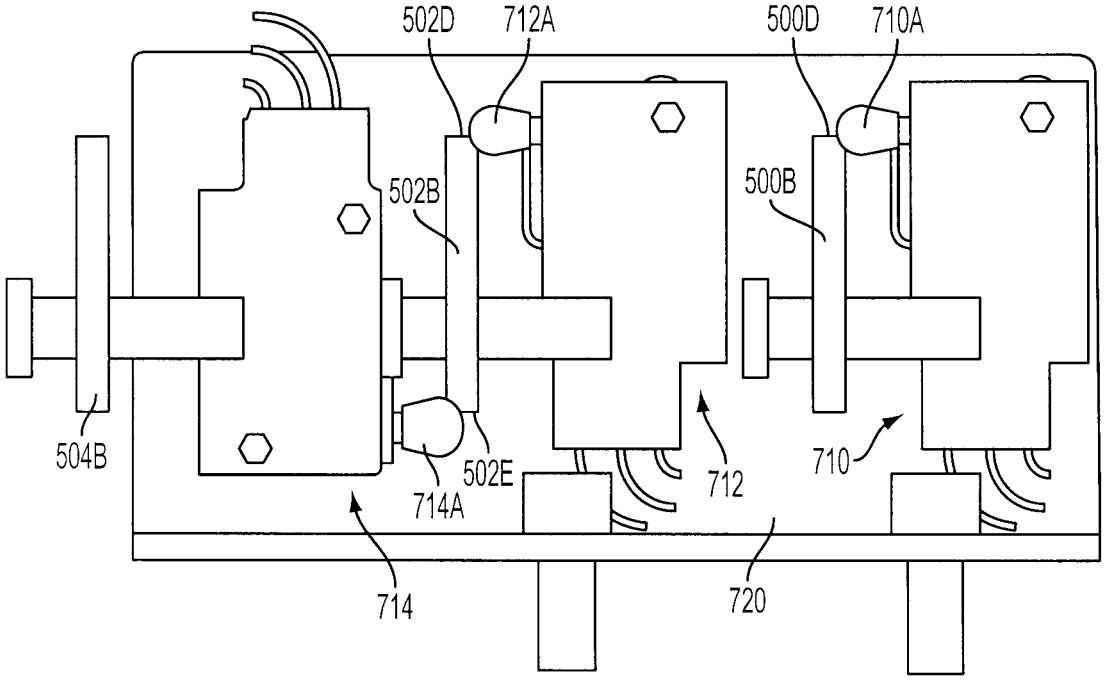
FIG. 11 is a view of first, second and third microswitches of the valve apparatus of the vehicle illustrated in FIG. 1.

As illustrated in FIGS. 3 and 11, first, second and third microswitches 710, 712 and 714 are bolted to a bracket 720, which, in turn, is bolted to the valve apparatus 72. In FIG. 11, an upper section 500D of the second end 500B of the linkage 500 is shown just engaging an actuator arm 710A of the first microswitch 710, and upper and lower sections 502D and 502E, respectively, of the second end 502B of the linkage 502 are shown just engaging respectively actuator arms 712A and 714A of the second and third microswitches 712 and 714.

When the hydraulic piston/cylinder units 128 have tilted the mast assembly 120 beyond a threshold amount in a direction away from the operator, e.g., 2 degrees from vertical, and the fork carriage mechanism 110 and the forks 100 are raised to the point where the mast members 124 and 126 are about to move relative to mast member 122, movement by the hydraulic cylinders for raising and lowering the mast members 124 and 126 relative to the mast member 122 is disabled, movement of a further hydraulic cylinder for raising and lowering the fork carriage mechanism 110 and the forks 100 relative to the mast member 126 is disabled, and movement of the mast assembly 120 via the hydraulic piston/cylinder units 128 is disabled. However, the fork carriage mechanism 110 and the forks 100 may be lowered if the first knob 160D is pushed in a direction away from the operator O such that the upper section 500D of the second end 500B of the linkage 500 moves relative to the actuator arm 710A so as to actuate the first microswitch 710. Further, the mast assembly 120 may be moved via the hydraulic piston/cylinder units 128 toward the operator O if an operator moves the second knob 161D beyond its neutral position in a direction toward the operator O such that a lower section 502E of the second end 502B of the linkage 502 moves relative to the actuator arm 714A of the third microswitch 714 so as to actuate that microswitch 714.

If the hydraulic cylinders for raising and lowering the mast members 124 and 126 have been actuated such that the mast members 124 and 126 have been vertically moved any amount relative to the mast member 122 and the second knob 161D is moved away from the operator O causing the hydraulic piston/cylinder units 128 to move the mast assembly 120 to a threshold position, e.g., 2 degrees from vertical, the second microswitch 712 is actuated causing movement of the hydraulic cylinders for raising and lowering the mast members 124 and 126 relative to the mast member 122 to be disabled, movement of the mast assembly 120 away from the operator to be disabled, and movement of the fork carriage mechanism 110 and the forks 100 to be disabled. If the second knob 161D is returned to its neutral position, the microswitch 712 is no longer actuated such that movement of the hydraulic cylinders for raising and lowering the mast members 124 and 126 relative to the mast member 122 may occur, movement of the mast assembly 120 toward the operator may occur, and movement of the fork carriage mechanism 110 and the forks 100 may occur. The second microswitch 712 is actuated when an operator moves the second knob 161D from a neutral position in a direction away from the operator O such that an upper section 502D of the second end 502B of the linkage 502 moves relative to the actuator arm 712A so as to actuate the second microswitch 712.

The valve apparatus 72 is coupled to the cowl 30 of the truck main body 20 via bolts 72A and nuts 72B, see FIG. 3.

Figure 1B:
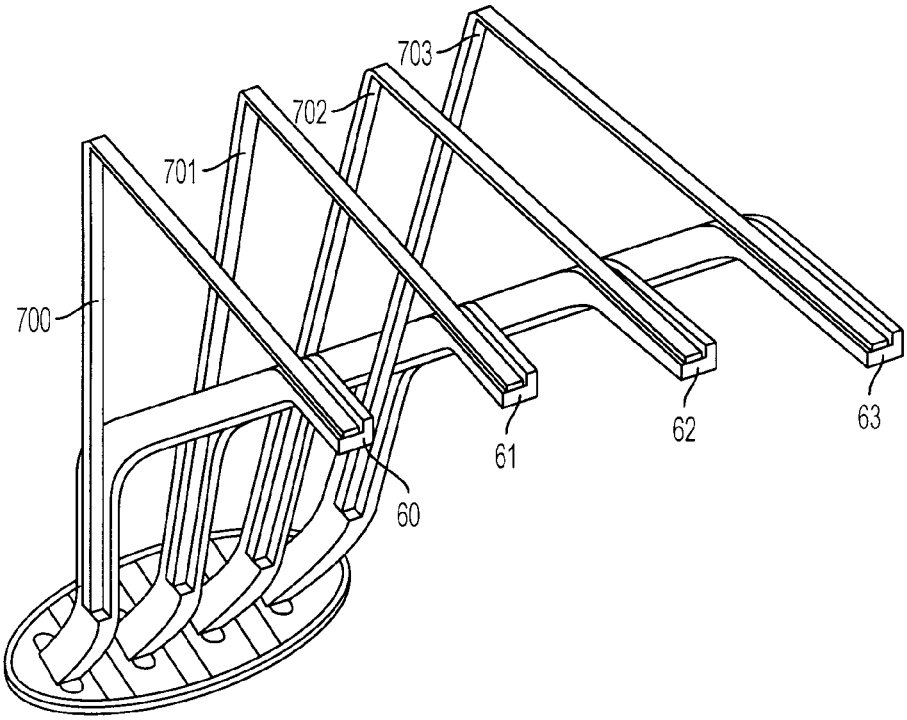
FIG. 1B is a perspective view of control levers of the control lever mechanism illustrated in FIGS. 1 and 1A and other control levers that have first and second sections extending at 90 degrees to one another.

In accordance with the present invention, the shape of each control lever 60-63 is configured to maximize a view zone $V_Z$ of an operator in seat 42 looking forward in the direction of the forks 100, see FIG. 1. More particularly, the shape of the control levers 60-63 has been designed so as to minimize blockage by the control levers 60-63 of an operator viewing window W defined by a right-side portion 120A of the mast assembly 120, as viewed by an operator in seat 42 and looking in the direction of the forks 100, and the right A-post 22, see FIG. 1A. Referring again to FIG. 1, the operator view zone $V_Z$ is defined by a lowermost view plane $VP_{LM}$ and all view planes located above the lowermost view plane $VP_{LM}$, including a view plane $VP_1$. The first, second, third and fourth lever structures 200, 210, 220 230 are configured such that the third sections 60C, 61C, 62C and 63C of the control levers 60-63 fall within or are approximately parallel with the lowermost view plane $VP_{LM}$ of the operator view zone $V_Z$. It is believed that by configuring the lever structures 200, 210, 220 and 230 in this manner, the operator view zone $V_Z$ can be maximized. In contrast, control levers 700-703 having a different configuration, i.e., first and second sections extending at generally 90 degrees to one another, are shown in phantom in FIG. 1 and in solid line in FIG. 1B, where the levers 700-703 extend into the operator view zone $V_Z$. Hence, if each of the first, second, third and fourth control levers were configured as levers 700-703, the operator view zone $V_Z$ would be reduced as the lowermost view plane would no longer comprise view plane $VP_{LM}$, but instead, would comprise view plane $VP_{LM700}$, see FIG. 1.

In accordance with an alternative embodiment of the present invention, the first, second, third and fourth lever structures 200, 210, 220 230 may have a different configuration. For example, as shown in phantom in FIG. 4, the first and second sections 60A and 60B of the first control lever may be combined into a single section 760A. Section 760A merges directly into the third section 760C such that the control lever includes only three sections instead of four. The second, third and fourth control levers may have a similar shape.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A control lever mechanism mounted to a cowl of a main body of a materials handling vehicle having at least one fork comprising:

at least one lever structure including a control lever having one section which defines a non-orthogonal angle with vertical, said control lever comprising another section, a further section and a distal section, said one section extending from said another section, said another section extending from said further section and said distal section extending directly from said one section in a direction away from said at least one fork and being located in a plane, which plane is closer to horizontal than to vertical; and apparatus for mounting said lever structure to the main body cowl, said further section including a generally linear portion extending away from said mounting apparatus.

2. A control lever mechanism as set out in claim 1, wherein said control lever has first, second, third and fourth sections, said third section defining said one section, said another section being defined by said second section, said further section being defined by said first section and said fourth section defining said distal section.

3. A control lever mechanism as set out in claim 2, wherein said one section is vertically spaced from both said first and second sections.

4. A control lever mechanism as set out in claim 3, wherein said fourth section includes an operator gripping portion and is joined directly to said one section, said one section being joined directly to said second section.

5. A control lever mechanism as set out in claim 2, wherein said first and second sections meet to define a first obtuse angle, said second and third sections meet to define a second obtuse angle, said third and fourth sections meet to define a third obtuse angle and said second, third and fourth sections have approximately a U-shape.

6. A control lever mechanism as set out in claim 5, wherein said fourth section includes an operator gripping portion.

7. A control lever mechanism as set out in claim 5, wherein a first side surface of said control lever is positioned in a first plane and a second side surface of said control lever is positioned in a second plane which is generally parallel to said first plane.

8. A control lever mechanism as set out in claim 1, wherein said lever structure further comprises a support element coupled to an end of said control lever and having a face positioned in a plane that is angled to a plane containing a side surface of said lever.

9. A control lever mechanism as set out in claim 8, wherein said support element comprises a boss coupled to said control lever.

10. A control lever mechanism as set out in claim 9, wherein said control lever end includes a bore and said boss extends at least part way through said bore and is welded to said control lever end.

11. A control lever mechanism as set out in claim 8, wherein said lever assembly further comprises an extension element coupled to said control lever end and being adapted to be coupled to a valve linkage and having a side wall parallel to said face of said support element.

12. A control lever mechanism as set out in claim 8, wherein said support element includes a bore and said apparatus for mounting said lever structure to the main body cowl comprises a bracket coupled to the main body cowl and a pin extending through said bore in said support element and holes in said bracket.

13. A control lever mechanism as set out in claim 1, wherein said at least one lever structure comprises first and second lever structures, said first lever structure including a first control lever having one section which defines a non-orthogonal angle with vertical and said second lever structure including a second control lever having one section which defines a non-orthogonal angle with vertical.

14. A control lever mechanism as set out in claim 13, wherein said first lever structure further comprises a first support element coupled to an end of said first control lever and having a first face positioned at a first angle to a plane containing a side surface of said first lever and said second lever structure further comprises a second support element coupled to an end of said second control lever and having a second face positioned at a second angle to a plane containing a side surface of said second lever, said second angle being greater than said first angle.

15. A control lever mechanism as set out in claim 14, wherein each of said first and second control levers has first, second, third and fourth sections, said third section defining said one section.

16. A control lever mechanism as set out in claim 15, wherein said fourth section of said second control lever has a length that is greater than a length of said fourth section of said first control lever.

17. A control lever mechanism as set out in claim 13, wherein said first and second control levers are cut from a solid, generally planar sheet of metal.

18. A control lever mechanism mounted to a cowl of a main body of a materials handling vehicle comprising:

at least one lever structure including a control lever having first, second, third and fourth sections, said second, third and fourth sections having approximately a U-shape, and said fourth section including an operator gripping portion, said third section being vertically spaced from said second section, wherein said fourth section extends directly from said third section and is located in a plane closer to horizontal than to vertical; and apparatus for mounting said lever structure to the main body cowl, said control lever first section having a generally linear portion extending away from said mounting apparatus.

19. A control lever mechanism as set out in claim 18, wherein said lever structure further comprising a support element coupled to an end of said control lever and having a face positioned in a plane that is angled to a plane containing a side surface of said control lever.

20. A control lever mechanism as set out in claim 18, wherein at least said second, third and fourth sections extend into an operator compartment of the materials handling vehicle.

21. A control lever mechanism mounted to a cowl of a main body of a materials handling vehicle comprising:

at least one lever structure including a control lever having a bore and a support element coupled to an end of said control lever, said support element comprising a boss extending at least part way through said control lever bore, fixed to said control lever end and having a face positioned in a plane that is angled to a plane containing a side surface of said control lever; and apparatus for mounting said lever structure to the main body cowl.

22. A control lever mechanism as set out in claim 21, wherein said control lever end includes said bore and said boss is welded to said lever end.

23. A control lever mechanism as set out in claim 21, wherein said lever structure further comprises an extension element coupled to said control lever end and being adapted to be coupled to a valve linkage and having a side wall parallel to said face of said support element.

24. A control lever mechanism as set out in claim 21, wherein said boss is fixed to said control lever so as not to move relative to said control lever.

25. A control lever mechanism as set out in claim 21, wherein said boss comprises an internal bore.

26. A control lever mechanism mounted to a cowl of a main body of a materials handling vehicle comprising:

at least one lever structure including a control lever and a support element coupled to an end of said control lever, said support element having a face positioned in a plane that is angled to a plane containing a side surface of said control lever; and apparatus for mounting said lever stricture to the main body cowl , wherein said at least one lever structure comprises first and second lever structures having first and second control levers, respectively, said first lever structure further comprises a first support element coupled to an end of said first control lever and having a first face positioned at a first angle to a plane containing a side surface of said first lever and said second lever structure further comprises a second support element coupled to an end of said second control lever and having a second face positioned at a second angle to a plane containing a side surface of said second lever, said second angle being greater than said first angle.

27. A control lever mechanism mounted to a cowl of a main body of a materials handling vehicle having at least one fork comprising:

at least one lever structure including a control lever having one section which defines a non-orthogonal angle with a vertical plane, said control lever comprising another section and a distal section, said one section extending from said another section and said distal section extending directly from said one section in a direction away from said at least one fork and being located in a plane, which plane is closer to horizontal than to vertical, wherein all of said one section and said distal section are located to one side of a vertical plane passing through a pivot point of said lever when said lever is in a neutral position; and apparatus for mounting said lever structure to the main body cowl.

28. A control lever mechanism mounted to a cowl of a main body of a materials handling vehicle having at least one fork comprising:

at least one lever structure including a control lever having one section which defines a non-orthogonal angle with vertical, said control lever comprising another section and a distal section, said one section extending from said another section, said one section and said another section having approximately the same length and said distal section extending directly from said one section in a direction away from said at least one fork and being located in a plane, which plane is closer to horizontal than to vertical; and apparatus for mounting said lever structure to the main body cowl.

* * * * *

UNITED STATES PATENT AND TRADEMARK OFFICE

CERTIFICATE OF CORRECTION

PATENT NO. : 8,225,693 B2
APPLICATION NO. : 11/689085
DATED : July 24, 2012
INVENTOR(S) : Julien J. Schrenk et al.

It is certified that error appears in the above-identified patent and that said Letters Patent is hereby corrected as shown below:

In the Specifications

Col. 9, line 27, "To assembly the first, second, third and fourth lever" should read --To assemble the first, second, third and fourth lever--.

Col. 15, line 4, "apparatus for mounting said lever stricture" should read --apparatus for mounting said lever structure--.

Signed and Sealed this
Seventh Day of May, 2013

Teresa Stanek Rea
*Acting Director of the United States Patent and Trademark Office*